US009659697B2

(12) United States Patent
Steigerwald et al.

(10) Patent No.: US 9,659,697 B2
(45) Date of Patent: May 23, 2017

(54) ACTUATOR WITH TRANSMISSION ELEMENT

(71) Applicant: Schaeffler Technologies AG & Co. KG, Herzogenaurach (DE)

(72) Inventors: Martin Steigerwald, Herzogenaurach (DE); Jens Hoppe, Groessweinstein (DE); Stefan Konias, Erlangen (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 14/896,090

(22) PCT Filed: Feb. 26, 2014

(86) PCT No.: PCT/DE2014/200089

§ 371 (c)(1),
(2) Date: Dec. 4, 2015

(87) PCT Pub. No.: WO2014/198264

PCT Pub. Date: Dec. 18, 2014

(65) Prior Publication Data

US 2016/0125990 A1 May 5, 2016

(30) Foreign Application Priority Data

Jun. 11, 2013 (DE) ..... 10 2013 210 871

(51) Int. Cl.
*H01F 7/17* (2006.01)
*H01F 7/08* (2006.01)
(Continued)

(52) U.S. Cl.
CPC ..... *H01F 7/08* (2013.01); *F01L 13/0036* (2013.01); *H01F 7/1607* (2013.01); *H01F 7/17* (2013.01);
(Continued)

(58) Field of Classification Search
CPC ..... F01L 9/04–2009/0498; F01L 2820/031; F01L 2013/101; F16K 31/06–31/10; H01H 51/32; H01F 7/17
(Continued)

(56) References Cited

U.S. PATENT DOCUMENTS 4,114,125 A 9/1978 Komatsu
5,797,586 A * 8/1998 Schulte ..... F16K 31/0682 251/129.02
2012/0266832 A1* 10/2012 Meisel ..... F01L 1/185 123/90.11

FOREIGN PATENT DOCUMENTS

DE 1464635 4/1969
DE 2636937 2/1977
(Continued)

*Primary Examiner* — Ramon M Barrera
(74) *Attorney, Agent, or Firm* — Davidson, Davidson & Kappel, LLC

(57) ABSTRACT

An actuator (1) including at least one electromagnet (121, 122, 13, 14, 16, 17, 181, 182, 19, a magnet housing (11), at least one thrust pin (24) and at least one movable armature (14) with a respective plunger (16) that is movable in an axial direction is provided. When the at least one electromagnet (10) is energized, an axial movement of the at least one armature (14) can be transmitted via the at least one plunger (16) to the at least one thrust pin (24). At least one lever (30) is provided which is pivotably mounted on one side in the magnet housing (11) and with which at least one plunger (16) and the at least one thrust pin (24) are operatively connected such that the axial movement of the at least one plunger (16) can be transmitted to the at least one thrust pin (24).

12 Claims, 3 Drawing Sheets

(51) Int. Cl.
*F01L 13/00* (2006.01)
*H01F 7/16* (2006.01)

(52) U.S. Cl.
CPC . *F01L 2013/0052* (2013.01); *F01L 2013/101* (2013.01); *F01L 2820/031* (2013.01)

(58) Field of Classification Search
USPC ..... 335/4, 5; 251/129.01–129.22; 123/90.11
See application file for complete search history.

(56) References Cited

FOREIGN PATENT DOCUMENTS

| | | | |
|---|---|---|---|
| DE | 10 2008 020 892 | A1 | 10/2009 |
| DE | 102008029324 | | 12/2009 |
| DE | 102008060169 | | 6/2010 |
| DE | 10 2011 078 525 | A1 | 1/2013 |
| EP | 0150607 | | 8/1985 |

* cited by examiner

ACTUATOR WITH TRANSMISSION ELEMENT

The present invention relates to an actuator. The actuator includes at least one electromagnet, a magnet housing, at least one thrust pin and at least one movable armature having a plunger which is movable in an axial direction. When the at least one electromagnet is energized, and axial movement of the at least one armature is transmittable to the at least one thrust pin via the at least one plunger.

BACKGROUND

Actuators, which are also referred to as "converters," "drive elements," and "adjusting devices," are known from the prior art. In particular, actuators are also known which convert electrical signals for at least one electromagnet into mechanical movement of an armature connected thereto. The armature, in turn, transmits at least part of the mechanical movement to a plunger, push rod or armature rod. The plunger (or push rod or armature rod) transmits at least part of the mechanical movement to at least one thrust pin, also referred to as a drive pin. The thrust pin transmits at least part of the mechanical movement to machine parts, for example to sliding cam (pieces) of a sliding cam system, which are adjusted or shifted by the aforementioned movements.

German patent applications DE 10 2008 020 892 A1 and DE 10 2011 078 525 A1 disclose actuators of the type mentioned at the outset.

The actuator in DE 10 2008 020 892 A1 includes a holding and releasing device, which fixes the thrust pin (actuator pin) in a holding position on support surfaces against the force of a pressure spring acting upon the thrust pin in the extension direction, not via magnetic forces of attraction but with the aid of a clamping effect as a result of friction-induced self-locking of a locking body. The holding and releasing device includes a stop valve, which is displaceable in the traversing direction of the thrust pin and independently thereof, as well as a flexible tongue, which applies force to the stop valve in the extension direction of the thrust pin. The flexible tongue applies force to an armature, which is fixedly connected to the stop valve, in the extension direction of the thrust pin. The actuator is used to adjust sliding cams. The disadvantage of the actuator is that the stop valve and the flexible tongue are delicate and high-precision components, which makes it expensive to mount the actuator and to manufacture its individual parts.

In the bistable actuator in DE 10 2011 078 525 A1, a pressure spring is supported on a latching device. A supporting spring which is oriented counter to the pressure spring and which is supported on a guiding sleeve for the thrust pin, or on a component connected thereto, engages with the thrust pin (actuator pin). Together with the latching device, the pressure and supporting springs form a bistable arrangement of the thrust pin. Due to this design, it is achieved that the extension of the thrust pin is initially induced by the electromagnet until a tilting point of the bistable arrangement of the thrust pin is reached and the latching device is released, so that the pressure spring then takes over the complete extension of the thrust pin into a sliding groove. A rocker is pivotable to two sides and supported centrally on an armature rod, which does not belong to the magnet housing. The rocker is operatively connected to the armature rod in such a way that the axial movement of the armature rod is transmittable to the thrust pin. The disadvantage of the actuator is that the additional supporting spring, the latching device and the rocker also represent a delicate and high-precision arrangement, which also makes it expensive to assemble and mount the actuator and to manufacture its individual parts.

SUMMARY OF THE INVENTION

It is an object of the present invention to provide an actuator which is suitable for a sliding cam system and is cost-effective to manufacture and to assemble.

The actuator according to the present invention includes at least one electromagnet, a magnet housing, at least one thrust pin and at least one movable armature having a plunger which is movable in an axial direction. When the at least one electromagnet is energized, an axial movement of the at least one armature is transmittable to the at least one thrust pin via the at least one plunger. The actuator also includes at least one lever which is supported pivotably to one side in the magnet housing. The at least one lever is operatively connected to the at least one plunger and the at least one thrust pin in such a way that the axial movement of the at least one plunger is transmittable to the at least one thrust pin. In particular, the at least one plunger abuts the lever for the purpose of transmitting force. The actuator is suitable for activating a sliding cam system. A lever in the actuator which is designed and situated in this way has the advantage that it is cost-effective to manufacture and to assemble.

A single electromagnet usually includes a solenoid coil, a magnetic yoke, a pole core, an armature and a plunger. The solenoid coil is surrounded by the magnetic yoke, pole core and magnet housing. In each solenoid coil, the armature is freely axially movable with the plunger. The plunger is connected to the armature to form a single piece or is integrated or a separate piece, which is fixedly or non-fixedly connected to the armature. The electromagnet may optionally include a permanent magnet, which holds the armature in a lower end position. If at least two electromagnets are situated in the magnet housing, each electromagnet may furthermore optionally include a return path element for better conduction of the magnetic flux, which closes the magnetic circuit of the electromagnet passing over the pole core and the armature. If only one electromagnet is situated in the magnet housing, a return path element may usually be dispensed with, because the magnet housing, for example, may be used as the return path.

In one specific embodiment of the present invention, the at least one plunger and the thrust pin assigned to the at least one plunger are situated in a parallel misalignment with respect to each other. A parallel misalignment of this type is present, in particular, in the case when at least two solenoid coils and at least two assigned thrust pins are provided, since the at least two solenoid coils usually have a relatively large overall size, while, in comparison thereto, a relatively small distance is present between the at least two thrust pins.

In another specific embodiment of the present invention, the at least one lever has a first lever end, a second lever end and a support area. The first lever end is supported pivotably around a bearing of the magnetic housing. The second lever end abuts a first end of the at least one thrust pin. The support area is situated between the first lever end and the second lever end and is operatively connected to the at least one plunger.

In one preferred specific embodiment, the bearing for the first lever end is a pin or a cylinder half, and the first lever end is supported thereon in a frictional or antifrictional manner.

The at least one lever is preferably manufactured by forming, for example using a stamping/bending method.

In one preferred specific embodiment, the second lever end has a convex indentation, and/or the first end of the assigned thrust pin has a convex elevation. Due to this design, no planar contact exists between the thrust pin and the assigned lever, but rather (ideally) only a contact at one point or on a line. The design according to the present invention of the contact between the lever and the thrust pin has the advantage that a reliable and better transmission of force from the lever to the thrust pin is implemented, which is independent of the lever position. In addition, the support area of the lever is designed as a trough-like indentation. Due to this design, the plunger abuts the lever in a stable manner, and the plunger is always in the correct working position. The convex surface and the trough-like indentation on the lever may be easily and cost-effectively manufactured on the formed lever. A convex surface on the first end of the thrust pin may likewise be easily and cost-effectively manufactured.

A stroke of the particular thrust pin is preferably adjustable with the aid of the position of the support area, which is situated between the first lever end and the second lever end and is operatively connected to the at least one plunger. The length of the stroke of the particular thrust pin, predefined by the particular lever, should be equal to or greater than the length of the predefined stroke of the assigned armature.

If the position of the support area on the lever is set in such a way that the two strokes are of the same length (transmission ratio 1:1), the size of movement of the plunger is completely converted into a movement of equal size of the corresponding thrust pin. The lever is preferably a rigid lever, since this prevents energy from being lost in the form of a deformation.

The position of the support area of the lever is, however, ideally set in such a way that the armature stroke is smaller compared to the thrust pin stroke, corresponding to the lever ratio set in this manner. Due to the smaller armature stroke, the particular solenoid coil may have a compact design, and thus the magnet housing, including it's at least one electromagnet, may also have a more compact design than that of a specific embodiment in which the at least one armature covers the complete thrust pin stroke. In the case of a small armature stroke, the actuator may have a compact design. A transmission ratio of approximately two has proven to be advantageous, the length of the stroke of the thrust pin thus being approximately twice the length of the stroke of the assigned armature. However, other transmission ratios may also be implemented.

Exemplary embodiments of the present invention and their advantages are explained in greater detail below on the basis of the attached figures. The proportions in the figures do not always correspond to the real proportions, since some shapes in the illustration have been simplified and other shapes have been enlarged in relation to other elements for the purpose of better demonstration.

DETAILED DESCRIPTION

Figure 1:
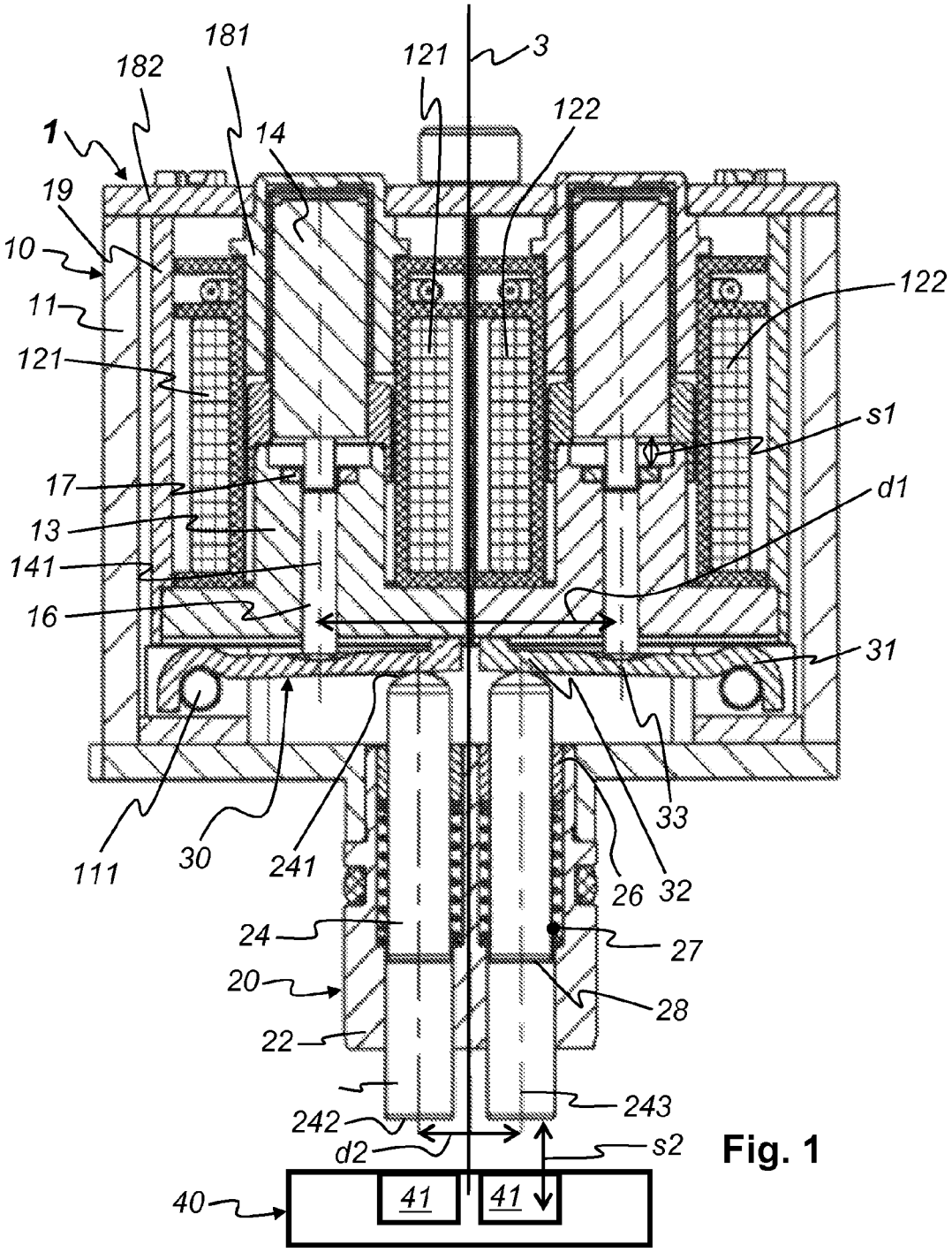
FIG. 1 shows a schematic representation of an actuator according to one specific embodiment of the present invention in a rest position.

Identical reference numerals are used for the same elements or elements having the same function. Furthermore, for the sake of clarity, only reference numerals which are necessary for describing the particular figure are shown in the individual figures. The illustrated specific embodiments only represent examples of how the actuator according to the present invention may be designed and do not represent a final limitation of the present invention.

FIG. 1 shows a schematic representation of an actuator 1 according to one specific embodiment of the present invention. The actuator essentially includes an electromagnet unit 10 and a thrust pin unit 20.

Electromagnet unit 10 includes at least one electromagnet 121, 122, 13, 14, 16, 17, 181, 182, 19 and a magnet housing 11. Each electromagnet usually includes a solenoid coil 121 and 122, a magnetic yoke, which in this case is optionally designed as a unit of a yoke sleeve 181 and a yoke disk 182, an optional return path element 19, a pole core 13, an armature 14 and a plunger 16. Solenoid coil 121, 122 is surrounded in each case by magnetic yoke 181, 182, return path element 19 and pole core 13. In each solenoid coil 121, 122, armature 14, including assigned plunger 16, is freely axially movable with respect to a particular armature axis 141. Plunger 16 is connected to armature 14 to form a single piece, or is integrated or is a separate piece, which is fixedly or non-fixedly connected to armature 14, armature 14 in the representation according to FIG. 1 resting upon plunger 16, and no fixed connection being present. A permanent magnet 17 is optionally provided, which holds armature 14 in the lower end position.

Thrust pin unit 20 includes at least one thrust pin 24 as well as optionally additional elements, such as a thrust pin housing 22, guiding sleeves 27 and/or pressure springs 27, which are described below.

When at least one of electromagnets 121, 122, 13, 14, 16, 17, 181, 182, 19 is energized, an axial movement with respect to armature axis 141 of particular assigned armature 14 is transmittable to assigned thrust pin 24 via assigned plunger 16. According to the present invention, at least one lever 30 is provided in actuator 1, which is supported pivotably to one side in magnet housing 11 and is operatively connected to plunger 16 assigned to it and thrust pin 24 in such a way that the axial movement of the at least one plunger 16 along armature axis 141 is transmittable to assigned thrust pin 24. Thrust pin 24 thus moves along a thrust pin axis 243, which is in a parallel misalignment with respect to armature axis 141.

In the specific embodiment according to FIG. 1, an electromagnet unit 10 is provided, for example, including two electromagnets 121, 122, 13, 14, 16, 17, 181, 182, 19. Each electromagnet includes one armature 14, one plunger 16, one lever 30 and one thrust pin 24. It is, however, obvious to those skilled in the art that the lever principle according to the present invention may also be applied with the aid of only one electromagnet, one armature 14, one plunger 16, one lever 30 and one thrust pin 24 as well as with the aid of more than two electromagnets, more than two armatures 14, more than two plungers 16, more than two levers 30 and more than two thrust pins 24. It is furthermore obvious to those skilled in the art that, depending on whether the activation of thrust pins 24 by the electromagnets is to take place synchronously or asynchronously with the aid of armature 14, plunger 16 and lever 30, the number of electromagnets, armatures 14, plungers 16 and levers 30 may be correspondingly equal to or less than the number of thrust pins 24. It is also obvious to those skilled in the art that, even with the same number of electromagnets, armatures 14, plungers 16, levers 30 and thrust pins 24, both a synchronous and an asynchronous activation of thrust pins 24 may take place. In the case of a synchronous activation, a correspondingly large number of electromagnets, including armatures 14, plungers 16, levers 30, activate the same number of thrust pins 24. If the transmission of force to multiple thrust pins 24 is to take place exclusively synchronously via second ends 242, only a single electromagnet, in particular, including one armature 14, one plunger 16 and one lever 30, may be used. This one lever 30 transmits the force to the multiple thrust pins 24. In the case of asynchronous activation, however, not all thrust pins 24 are actuated at the same time, and at least two electromagnets, including particular armature 14, plunger 16 and lever 30 and at least two thrust pins 24, are required for one actuator 1.

By transmitting force with the aid of armatures 14, plungers 16, levers 30 and thrust pins 24, actuator 1 activates machine parts to be actuated, for example, sliding groove 41 of a sliding cam piece 40.

In the representation according to FIG. 1, plungers 16 are designed in the shape of rods. However, it is obvious to those skilled in the art that they may have another shape which is suitable for transmitting force from armatures 14 to levers 30.

In the specific embodiment of actuator 1 according to the present invention according to FIG. 1, solenoid coils 121, 122 or plungers 16 or armature axes 141, on the one hand, and thrust pin axes 243, on the other hand, are not arranged in a line, due to the overall size of solenoid coils 121, 122 of the electromagnet and short distance d2 between the two thrust pins 24, but instead they have a relatively large parallel misalignment with respect to each other. In particular, a distance d1 between two adjacent solenoid coils 121, 122 or associated plungers 16 and armature axes 141 is greater than distance d2 between the two thrust pin axes 243 of assigned adjacent thrust pins 24.

In the specific embodiment according to FIG. 1, each lever 30 of actuator 1 includes a first lever end 31, a second lever end 32 and a support area 33. First lever end 31 is supported pivotably around a bearing 111 in magnet housing 11. Second lever end 32 abuts against a first end 241 of the at least one thrust pin 24. Support area 33 is situated between first lever end 31 and second lever end 32 and is operatively connected to the at least one plunger 16.

In the specific embodiment according to FIG. 1, bearing 111 for first lever end 31 is a pin which has a circular cross section. In another specific embodiment, bearing 111 is, for example, a cylinder half (see FIG. 4). Regardless of the design of bearing 111, first lever end 31 is always supported thereon in a frictional or antifrictional manner.

The at least one lever 30 is preferably manufactured by forming, for example using a stamping/bending method. In the representation according to FIG. 1, second lever end 32 of each of the two levers 30 has a planar contact surface opposite a convex elevation on first end 241 of particular assigned thrust pin 24. Due to this design, an essentially punctiform or linear contact exists between particular thrust pin 24 and particular assigned lever 30, which implements a better and safer transmission of the movement from lever 30 to thrust pin 24. In the representation according to FIG. 1, support area 33 of each of the two levers 30 is also designed as a trough-like indentation, in which particular plunger 16 rests and wherein it is supported in a stable manner during its actuation.

At level 30, stroke s2 of particular thrust pin 24 is preferably adjustable with the aid of the position of support area 33, which is situated between first lever end 31 and second lever end 32 and is operatively connected to the at least one plunger 16. In particular, the length of stroke s2 of particular thrust pin 24, predefined by particular lever 30, should be equal to or greater than the length of stroke s1 of assigned armature 14. A transmission ratio of approximately two has proven to be advantageous, the length of stroke s2 of thrust pin 24 thus being approximately twice the length of stroke s1 of assigned armature 14. However, other transmission ratios may also be implemented.

A permanent magnet 17 may be integrated or situated on pole core 13 and/or on armature 14, which prevents assigned thrust pin 24 from being prematurely pressed out of sliding groove 41 by pressure spring 27 when the voltage for the electromagnet is cut off. Alternatively, solenoid coils 121, 122 may also be energized until the displacement of sliding cam piece 40 of the sliding cam system is completed. Alternatively, however, a very rapid current decay must be ensured to obtain an evaluatable reflection signal upon refraction of thrust pins 24 or one of the two thrust pins 24 into thrust pin housing 22 and thus upon the return stroke of armatures 14 or respective armature 14. It is obvious to those skilled in the art that this energizing and this rapid current decay must be carried out independently of the number of electromagnets and thrust pins 24.

As illustrated in FIG. 1, thrust pins 24 are seated, for example, in a thrust pin housing 22 of thrust pin unit 20 and are axially displaceably guided therein with respect to their particular thrust pin axes 243. Thrust pins 24 are thus displaceably guided with respect to their central movement axis 3 and freely rotate around particular thrust pin axis 243. A guiding sleeve 26 may be provided for each thrust pin 24 in thrust pin housing 22. Guiding sleeve 26 and thrust pin 24 usually form a unit. One pressure spring 27 for each thrust pin 24 is supported on thrust pin housing 22 and on guiding sleeve 26 of associated thrust pin 24. Thrust pins 24 are held in their axial position thereby.

A shoulder 28 may be optionally formed on thrust pin 24, so that the diameter of thrust pin 24 above shoulder 28 is slightly different than the diameter of thrust pin 24 below shoulder 28.

In the representation according to FIG. 1, the axial position of both thrust pins 24 is at the top near the electromagnet, i.e., in the so-called rest position, in which sliding cam piece 40 is not being actuated by actuator 1. Upon completion of the force transmission by the at least one armature 14, the at least one plunger 16, the at least one lever 30 to the at least one thrust pin 24, the axial position of the at least one thrust pin 24 is at the bottom in the so-called working position. Only one of thrust pins 24 then engages with assigned sliding groove 41, regardless of whether only one or multiple thrust pins 24 were extended downward (not illustrated but indicated by the lower end of stroke s2 of thrust pin 24). This one thrust pin 24 then displaces sliding cam piece 40. Depending on the shape of sliding groove 41, in one specific embodiment only a single thrust pin 24 may be fully extended (asynchronous actuation). In another specific embodiment, however, multiple thrust pins 24 may be extended synchronously, with a corresponding, different shape of sliding groove 41, in such a way that only a single thrust pin 24 is fully extended and ultimately engages with a sliding groove 41 assigned to it, and the other thrust pins 24 do not engage with sliding groove 41 assigned to them, even if they are extended to at least part of corresponding stroke s2. In both specific embodiments, therefore, only a single thrust pin 24 is ultimately always extended up to the end of its stroke s2 and retracted into particular assigned sliding groove 41, to avoid damage to thrust pins 24 and/or damage to sliding grooves 41 and ultimately damage to the engine of the system in which actuator 1 is used. The system is, for example, a motor vehicle having an internal combustion engine.

Figure 2:
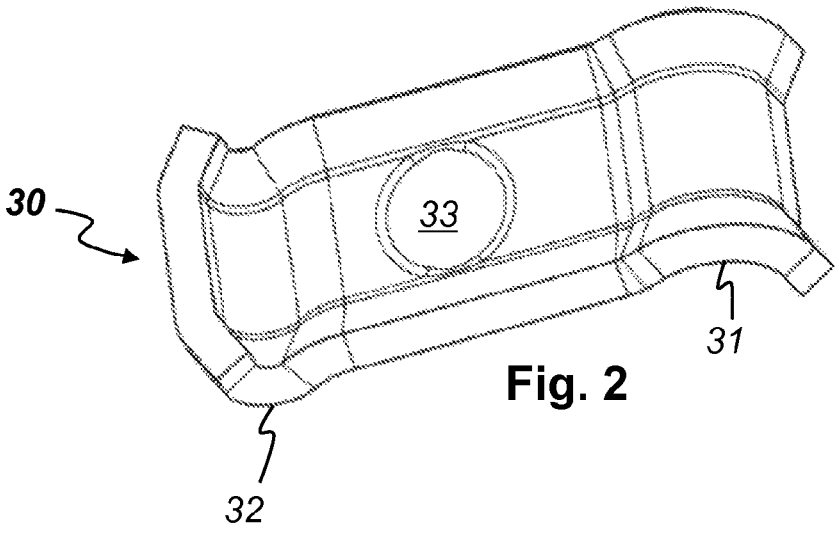
FIG. 2 shows a perspective top view of a lever which is provided in an actuator in another specific embodiment of the present invention.
Figure 3:
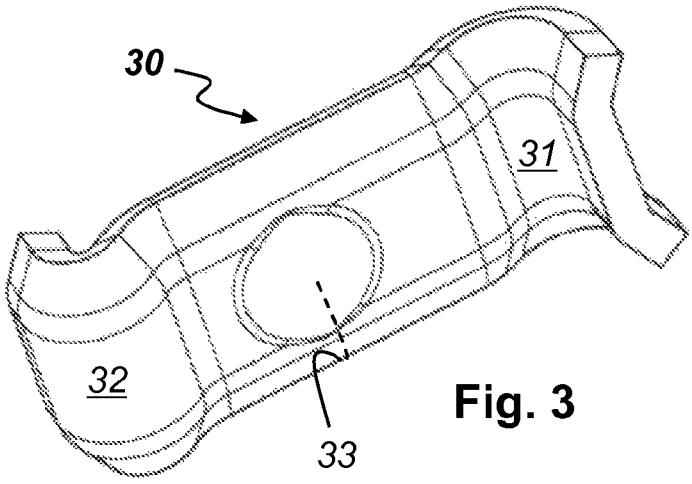
FIG. 3 shows a perspective bottom view of the lever according to FIG. 2.
Figure 4:
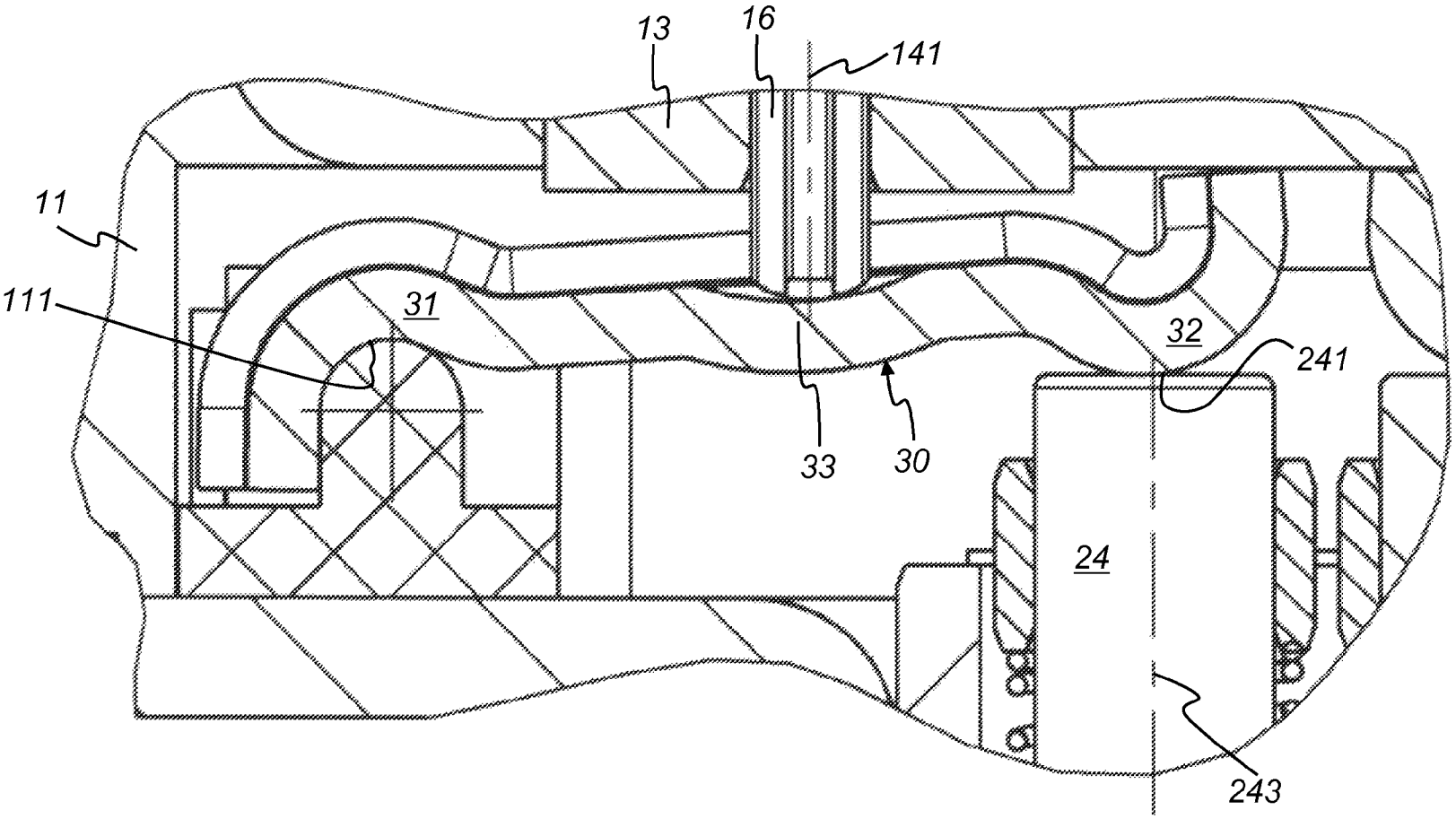
FIG. 4 shows a detailed view of the lever according to FIG. 2, installed in the other specific embodiment of the actuator according to the present invention.

FIG. 2 shows a perspective top view of a lever 30 which is provided in an actuator 1 in a specific embodiment of the present invention other than the one in FIG. 1. FIG. 3 shows a perspective bottom view of lever 30 according to FIG. 2. Lever 30 is manufactured by forming, for example using a stamping/bending method. In contrast to levers 30 in FIG. 1, second lever end 32 herein has a convex or cylindrical elevation. As illustrated in FIG. 4, this convex or cylindrical elevation is located on first end 241 of particular assigned thrust pin 24. As in FIG. 1, support area 33 of lever 30 in FIG. 2 is also formed as a trough-like indentation. First lever end 31 has a formed, cylindrical receptacle, in which bearing 111 (see FIG. 4) is accommodated for first lever end 31.

FIG. 4 shows a detailed view of lever 30 according to FIG. 2 and FIG. 3. Lever 30 is installed in another specific embodiment of actuator 1 according to the present invention. In the specific embodiment illustrated herein, bearing 111 has the shape of a half-cylinder and interacts with the cylindrical receptacle formed on first lever end 31.

LIST OF REFERENCE NUMERALS

1 actuator (adjusting device)
3 movement axis
10 electromagnet unit
11 magnet housing
111 bearing (housing pin)
121, 122 solenoid coil
13 pole core
14 armature
141 armature axis
16 plunger (push rod)
17 permanent magnet
181 yoke sleeve
182 yoke disk
19 return path element
20 thrust pin unit
22 thrust pin housing
24 thrust pin (drive pin, actuator pin)
241 first end of the thrust pin
242 second end of the thrust pin
243 thrust pin axis
26 guiding sleeve
27 pressure spring
28 shoulder
30 lever
31 first lever end
32 second lever end
33 support area
40 sliding cam piece
41 sliding groove
d1 distance between two adjacent plungers
d2 distance between two adjacent thrust pins
s1 stroke of the armature
s2 stroke of the thrust pin

The invention claimed is:

1. An actuator comprising:

at least one electromagnet;

a magnet housing;

at least one thrust pin;

at least one movable armature having a plunger movable in an axial direction, an axial movement of the at least one armature being transmittable to the at least one thrust pin via the at least one plunger when the at least one electromagnet is energized; and at least one lever supported pivotably to one side in the magnet housing and operatively connected to the at least one plunger and the at least one thrust pin in such a way that the axial movement of the at least one plunger is transmittable to the at least one thrust pin, and a thrust pin housing housing the at least one thrust pin, the thrust pin extending out of the thrust pin housing in an actuating position for contact with a sliding cam piece.

2. The actuator as recited in claim 1 wherein the at least one plunger and the thrust pin assigned to the at least one plunger are situated in a parallel misalignment with respect to each other.

3. The actuator as recited in claim 1 wherein the at least one lever includes: a first lever end supported pivotably around a bearing of the magnet housing; a second lever end abutting against a first end of the at least one thrust pin; and a support area situated between the first lever end and the second lever end and operatively connected to the at least one plunger.

4. The actuator as recited in claim 3 wherein the bearing for the first lever end is a pin or a cylinder half, and the first lever end is supported in a frictional or antifrictional manner.

5. The actuator as recited in claim 3 wherein the at least one lever is a formed lever, and wherein the second lever end has a convex indentation, or the first end of the thrust pin has a convex elevation, or the support area of the lever is formed as a trough-like indentation.

6. The actuator as recited in claim 5 wherein the lever is a bent or stamped lever.

7. The actuator as recited in claim 3 wherein a stroke of the thrust pin is adjustable with the aid of the location of the support area.

8. The actuator as recited in claim 7 wherein a length of the stroke of the thrust pin, predefined by the lever, is equal to or greater than the length of the stroke of the armature.

9. The actuator as recited in claim 8 wherein the length of the stroke of the thrust pin is twice the length of the stroke of the armature.

10. A sliding cam system comprising:

an actuator comprising: at least one electromagnet; a magnet housing; at least one thrust pin; at least one movable armature having a plunger movable in an axial direction, an axial movement of the at least one armature being transmittable to the at least one thrust pin via the at least one plunger when the at least one electromagnet is energized; and at least one lever supported pivotably to one side in the magnet housing and operatively connected to the at least one plunger and the at least one thrust pin in such a way that the axial movement of the at least one plunger is transmittable to the at least one thrust pin; and a sliding cam piece, the thrust pin interacting with the sliding cam piece.

11. The sliding cam system as recited in claim 10 wherein the thrust pin interacts with a sliding groove of the sliding cam piece.

12. A cam actuator comprising:

two electromagnets;

two magnet housings;

two thrust pins;

two movable armatures each having a plunger movable in an axial direction, an axial movement of a respective armature of the armatures being transmittable to a respective thrust pin of the thrust pins via a respective plunger of the plungers when a respective electromagnet of the two electromagnets is energized; and levers supported pivotably to one side in the magnet housing and operatively connected to the plungers and the thrust pins in such a way that the axial movement of the respective plunger is transmittable to the respective thrust pin.

* * * * *